US005575481A

United States Patent [19]

Lovetere et al.

[11] Patent Number: 5,575,481

[45] Date of Patent: Nov. 19, 1996

[54] VOLLEYBALL TRAINING AID

[75] Inventors: John F. Lovetere; Lyne A. Lovetere, both of Plano, Ill.

[73] Assignee: Rip Tide Volleyball, Plano, Ill.

[21] Appl. No.: 294,305

[22] Filed: Aug. 23, 1994

[51] Int. Cl.[6] ..... A63B 69/00

[52] U.S. Cl. ..... 273/411; 273/1.5 A; 273/413; 273/58 C

[58] Field of Search ..... 273/411, 1.5 A, 273/58 C, 1.5 R

[56] References Cited

U.S. PATENT DOCUMENTS

| | | | |
|---|---|---|---|
| 1,753,310 | 8/1930 | Costello | 273/411 |
| 2,710,189 | 1/1955 | Caroll | 273/1.5 A |
| 2,740,630 | 4/1956 | Robinson | 472/86 |
| 3,650,530 | 3/1972 | Gantz | 273/1.5 R |
| 3,897,950 | 8/1975 | Keller | 273/411 |
| 3,910,574 | 10/1975 | Voltz | 273/1.5 A |
| 4,948,150 | 8/1990 | Daly | 273/411 |
| 5,060,946 | 10/1991 | Taylor . | |
| 5,238,251 | 8/1993 | Staka . | |
| 5,280,843 | 1/1994 | Vartija | 273/411 |
| 5,338,044 | 8/1994 | Mazursky | 273/1.5 A |

FOREIGN PATENT DOCUMENTS

| | | | |
|---|---|---|---|
| 1644988 | 4/1991 | U.S.S.R. | 273/411 |

OTHER PUBLICATIONS

Excel Volleyball Products, pp. 16 and 17. Advertisement prior to invention date, publication unknown.

"Volleyball Teaching Aids". Advertisement prior to invention date, publication unknown.

"The V.B. Trainer". Advertisement prior to invention date, publication unknown.

*Primary Examiner*—Theatrice Brown

*Attorney, Agent, or Firm*—Hill, Steadman & Simpson

[57] ABSTRACT

A volleyball training device is provided which is mountable to a standard basketball hoop. A backboard is configured to rest on the hoop so that the hoop and an associated bracket are received in a recess in the backboard. A pair of elastic straps are stretched across the backboard under the hoop to secure the backboard in position and to hold up a basketball net out of the way. A tether is secured to the backboard and is arranged to suspend a volleyball in position to receive practice spiking hits.

23 Claims, 2 Drawing Sheets

VOLLEYBALL TRAINING AID

BACKGROUND OF THE INVENTION

The present invention generally relates to sports training devices. More particularly, the present invention relates to a training device for spiking a volleyball.

Spiking is a term which refers to a fundamental maneuver in the game of volleyball where an elevated volleyball is stricken by a player at a generally downward angle. Volleyball practice and training often includes refinement of players' spiking skills. It is desirable to practice spiking without having to repeatedly set and retrieve a loose volleyball.

Volleyball spiking aids are known. For example, U.S. Pat. Nos. 5,060,946 and 5,238,251 relate to devices which have a floor stand, a vertical pole, and a horizontal arm from which a volleyball is outwardly extended. Also, U.S. Pat. No. 4,948,150 relates to a device having an adjustable mount attached to the pole of a volleyball net. It has a vertical extension from which a horizontal arm outwardly extends to suspend a volleyball. This patent further discloses a device having an arm which is clamped to front and rear portions of a basketball hoop with front and rear hooks. The arm extends outwardly from the hooks, supporting a horizontal board from which a tethered volleyball is hung.

These devices include numerous, bulky components, and can require tools for setting up. Also, prior art devices are generally high priced. Many potential purchasers of such training devices are institutions which have limited funding, such as schools. A need, therefore, exists for an improved volleyball training aid which is simple, convenient, has relatively few components, and which is inexpensive.

SUMMARY OF THE INVENTION

The present invention provides a simple device with few components. More specifically, the present invention relates to a volleyball training aid which can be quickly and conveniently set up, and which is inexpensive to produce. The present invention takes advantage of existing basketball hoops. Basketball hoops are extremely common in recreational areas where volleyball skills are desirably practiced. The invention is mountable to a basketball hoop, rendering unnecessary the need for and cost of some other vertical stand.

To this end, in an embodiment, a volleyball training device is provided which includes a backboard configured to rest on top of a basketball hoop. A tether is secured to the backboard. A means is provided for securing a standard volleyball to the tether. Furthermore, the backboard has a recess or indentation shaped to receive the basketball hoop.

In an embodiment, a handle is provided in the backboard. In an embodiment, the tether is a length of elastic tubing. In an embodiment, the means for securing a volleyball is at least two elastic bands.

In an embodiment, the volleyball training device also includes a means for securing the backboard to the basketball hoop. In a related embodiment, the means for securing the backboard is at least one length of elastic strap secured across a bottom side of the backboard. An end of the strap is knotted through a hole or recess adjacent one edge of the backboard and the opposite end of the strap is knotted and securable in a slot in an opposite edge of the backboard.

In an embodiment, the tether is adjustably secured to the backboard in a position within the hoop.

In an embodiment, the recess or indentation is shaped to also receive a bracket on which the hoop is mounted. In a related embodiment, the recess is stepped in shape to cooperatively receive one of multiple standard sizes for the bracket.

In an embodiment, the tether is made of tubular elastic material.

In an embodiment, the tether extends through a plurality of holes in the backboard.

It is, therefore, an advantage of the present invention to provide a volleyball training device which can be conveniently set up on a basketball hoop.

Another advantage of the present invention is to provide a volleyball training device which is simple to set up.

A further advantage of the present invention is to provide a simple volleyball training device which has few components.

An additional advantage of the present invention is to provide a volleyball training device which can be manufactured inexpensively.

Yet another advantage of the present invention is to provide a volleyball training for suspending a volleyball at a desired height.

A still further advantage of the present invention is to provide a volleyball training device which positions a volleyball for repeated practice hits.

Moreover, an advantage of the present invention is that it provides a realistic feel to spiking a volleyball.

Still another advantage of the present invention is to provide a volleyball training device which is portable.

Additional features and advantages of the present invention are described in, and will be apparent from, the detailed description of the presently preferred embodiments and from the drawings.

DESCRIPTION OF THE PREFERRED EMBODIMENTS

Figure 1:
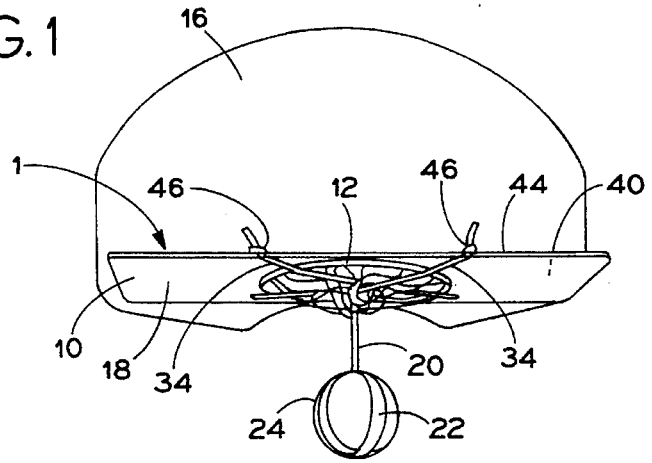
FIG. 1 illustrates a front, lower perspective view of a volleyball training device mounted on a basketball hoop.
Figure 2:
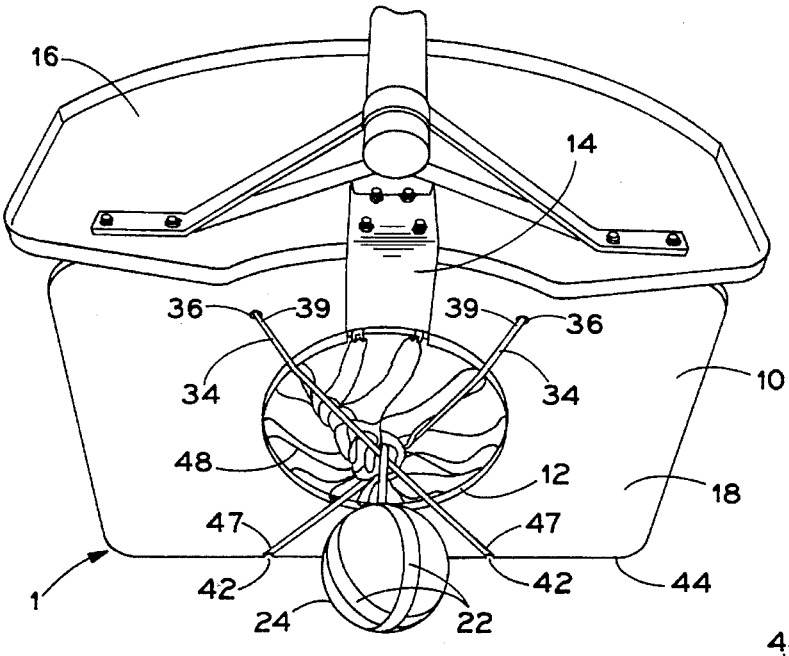
FIG. 2 illustrates a rear, lower perspective view of a volleyball training device mounted on a basketball hoop.
Figure 3:
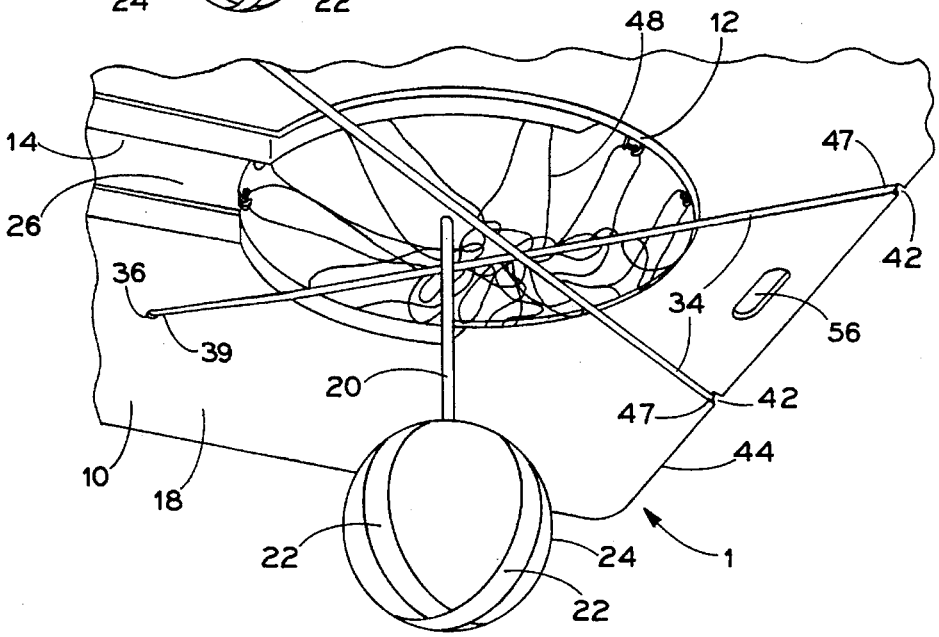
FIG. 3 illustrates a partial side, rear, lower perspective view of a volleyball training device mounted on a basketball hoop.

In accordance with the invention described with reference to the accompanying figures wherein like numerals designate like parts, a volleyball training device 1 is provided, as illustrated in FIGS. 1–3. The volleyball training device 1 has a backboard 10 which configured to rest upon a standard sized basketball hoop 12.

A basketball hoop 12 is common in recreational areas such as gymnasiums, school yards, playgrounds, parks, residential driveways, etc. The volleyball training device 1 is configured to be conveniently mounted to any such hoop 12. The basketball hoop 12 is usually mounted at a vertical elevation of ten feet above floor level, although hoops 12 are sometimes mounted lower or are mounted in a vertically adjustable manner, particularly for use by children. As illustrated in FIG. 2, the basketball hoop 12 extends outwardly on a bracket 14 from a vertically disposed backstop 16. The hoop 12, bracket 14, and backstop 16 are not elements of the device 1.

The backboard 10 rests generally horizontally on the hoop 12, so that a bottom side 18 of the backboard 10 faces downward. A tether 20 has an end secured to the backboard 10. Another end of the tether 20 is secured to a pair of elastic bands 22 which can retain a volleyball 24. Preferably, the bands 22 are about an inch wide so as to securely hold the volleyball 24 in place.

Figure 4:
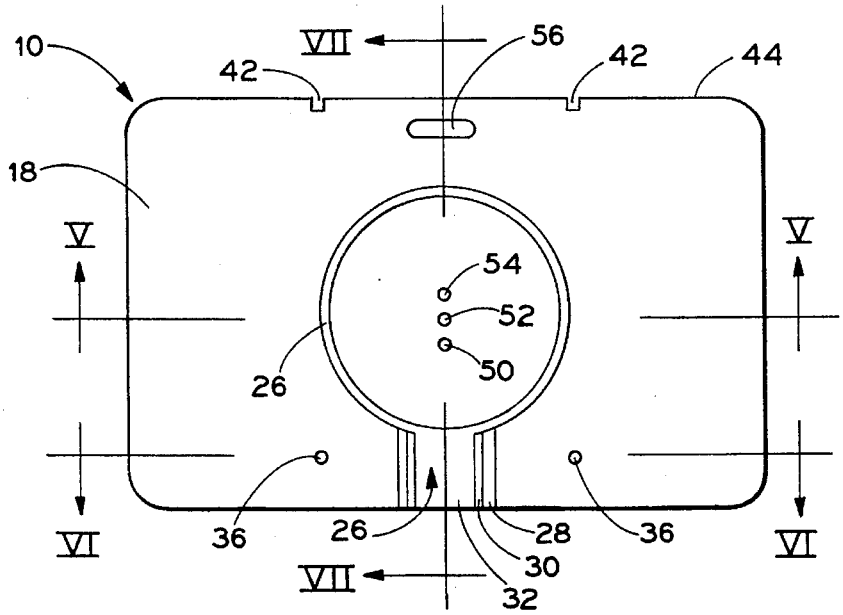
FIG. 4 illustrates a bottom plan view of a backboard of a volleyball training device according to the present invention.
Figure 5:
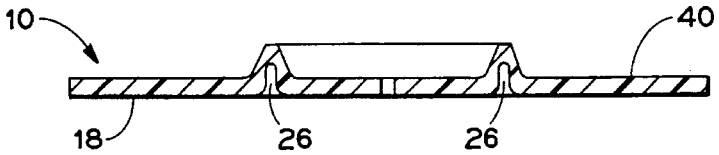
FIG. 5 illustrates a sectional view taken generally along line V—V of FIG. 4.

Referring to FIG. 4, the backboard 10 has a recess 26 shaped to receive the hoop 12 and bracket 14. The recess 26 provides stability to the backboard 10, preventing it from sliding or turning as it rests on the hoop 12 and bracket 14. To receive a standard sized hoop, the hoop portion of the recess, illustrated in FIG. 5, is sized to have an inner diameter of one foot, five and one-half inches and an outer diameter of one foot seven and one-half inches. Furthermore, the recess 26 is preferably one inch deep from the bottom side 18 of the backboard 10.

Figure 6:
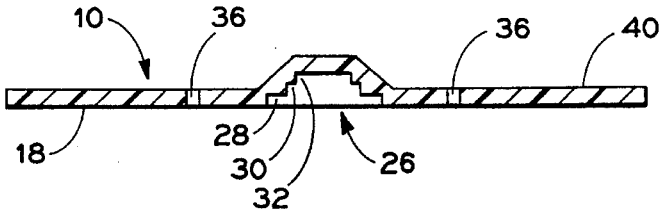
FIG. 6 illustrates a sectional view taken generally along line VI—VI of FIG. 4.

While the hoop 12 of a basketball goal is universally sized, the bracket 14 is not as universal. The width of the bracket 14 can vary among basketball goal manufacturers. Therefore, as illustrated in FIG. 6, the portion of the recess 26 which is shaped to receive the bracket 14 is stepped in shape, forming a first step 28, a second step 30, and a third step 32, respectively from the bottom side 18. This configuration allows the recess 26 to receive the bracket 14 of most major basketball goal manufacturers.

The first step 28 is preferably eight inches wide and three-eights of an inch deep. The second step 30 is preferably six and one-half inches wide and an additional three-eights of an inch deep. The third step is preferably five and an additional one-half inches wide and one quarter inch deep. However, the recess 26 can be any shape which accommodates a particular bracket 14 so that the hoop 12 and bracket 14 preferably are recessed at least enough to be flush with the bottom side 18 of the backboard 10.

Turning attention back to FIGS. 1–3, a pair of straps 34 are secured to the backboard 10. After the backboard 10 has been placed on the basketball hoop 12, the straps are stretched across the bottom side 18 of the backboard 10 under the hoop 12 to hold the backboard 10 fixed relative to the hoop 12. Each strap 34 extends through a hole 36 at or near a rear edge 30 of the backboard 10, laterally displaced from a center of the backboard. Each strap 34 preferably has a knot formed at a first end 39 of the strap to engage on a top side 40 of the backboard 10, although other arrangements may be made to secure the end 39 of the strap 34 to the backboard. The knot is sized so that the knot cannot be pulled through the hole 36.

Slots 42 are provided in a front edge 44 of the backboard 10. The straps 34 are pulled across the bottom side 18 of the backboard 10 so that knots 46 in a second ends 47 of the straps 34 can be captured above the slots 42 when the straps are placed into the slots 42. The straps 34 are preferably sized so that the knots 46 cannot be pulled through. Again, other arrangements may be made to secure the second ends 47 of the straps 34 to the backboard 10. The straps 34 preferably cross each other. A basketball net 48 which is attached around the hoop 12 can be tucked under the straps 34 to hold the net 48 out of the way when the straps are crossed under the hoop 12. Therefore, the net 48 will not interfere with motion of the tether 20 or the volleyball 34, yet the net 48 does not have to be removed.

Figure 7:
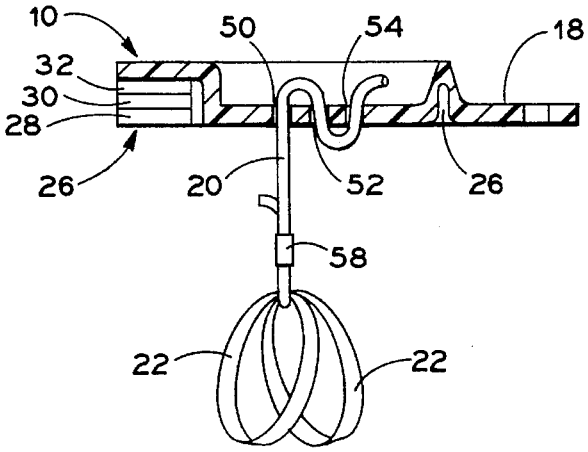
FIG. 7 illustrates a sectional view taken generally along line VII—VII of FIG. 4.

The tether 20 is secured centrally to the backboard 10 so that the tether 20 hangs downward from the bottom side 18 through the middle of the hoop 12. The tether 20 is secured to the backboard 10 by passing it through three adjacent holes 50, 52 and 54 in a serpentine manner (FIG. 7). The tether 20 hangs out of the hole 50. The three holes 50, 52, and 54 allow for vertical adjustability of the tether 20, yet provide sufficient gripping that tension on the tether 20 will not cause it to come loose. Alternatively, a clamp (not shown) could be used to secure the tether 20 to the backboard 10.

Preferably, the tether 20 and the straps 34 are made of tubular elastic material such as Ethylene-Propylene-Diene-Monomer (EPDM), or some other suitable natural or synthetic co-polymer rubber such as Styrene-Butadiene Rubber (SBR) or Nitrile-Butadiene Rubber (NBR). Elasticity of the tether 20 results in a more realistic, untethered feel when striking the volleyball 24. Alternatively, the tether 20 or the straps 34 can be made of some other elastic material, rope, fabric or cable. Also, the shape of the tether 20 and the straps 34 can be a shape other than tubular, such as a flat shape. The materials used to make the tether 20 and straps 34 are preferably resistant to outdoor elements.

The backboard 10 is preferably made of fiberglass material. Also, the backboard 10 is preferably dimensioned to be portable, being forty-eight inches by twenty-nine inches by three sixteenths of an inch. At such a size and composition, the backboard 10 weighs approximately sixteen pounds. The backboard 10 also has a handle cutout 56. Thus, the backboard 10 can be easily stored, transported, and carried. It should be understood that the backboard 10 could be constructed of other rigid materials such as plastic, composites, wood or metal. The volleyball training aid thus can be constructed from a very few relatively inexpensive components.

As illustrated in FIG. 7, the elastic bands 22 are secured to the hanging end of the tether 20. The tether 20 is folded around the bands 22. This folded portion of the tether 20 is then wrapped with a plastic tie and covered by a heat shrink sleeve 58. Each of the bands 32 is then stretched over the volleyball 24 at right angles to the other to secure the volleyball 24 to the tether 20. Alternatively, some other means of securing the tether to the volleyball could be used. For instance, the tether could be laced under the cover of the volleyball or tied to an eyelet attached to the volleyball, however, the preferred method of attachment allows a standard volleyball 24 to be used, and allows for quick assembly and disassembly of the volleyball to the training device 1 without the possibility of any damage to the volleyball.

The tether 20 is adjustable to any desired height between approximately six and one-half feet and as high as the basketball hoop 12 will allow. Usually, the tether 20 is adjusted to hang the volleyball 24 at nine and one-half feet above ground level, which is the spiking height at which a majority of players practice.

The secured volleyball 54 can be hit by a person's hand. The volleyball 24 then swings upward on the tether 20 from the energy of the hit and bounces off of the backboard 10 until the energy dissipates. After the volleyball 24 substantially loses its motion, another practice hit can occur. In this manner, spiking can be repeatedly practiced without chasing or retrieving the volleyball and with a minimum delay between hits.

To assemble the volleyball training aid 1 for use, the volleyball 24 has the bands 22 applied around it and the tether 20 is secured to the backboard 10. The backboard 10 is placed on top of the basketball hoop 12 so that the bracket 14 will be captured in the appropriate step 28, 30 and 32. The straps 34 are then crossed below the hoop 12 to hold the net up out of the way and to clamp the backboard 10 to the hoop 12 in a secure fashion. The volleyball training aid is then ready to use. These steps, of course, can be done in different order, such as if the backboard 10 is left in place on the hoop 12 and the volleyball 24 is placed into and removed from the straps 22 as the need for practice requires. Thus, assembly and disassembly of the volleyball training aid can occur quickly and with a minimum amount of effort.

It should be understood various changes and modifications to the presently preferred embodiments described herein will be apparent to those skilled in the art. Such changes and modifications may be made without departing from the spirit and scope of the present invention, and without diminishing its attendant advantages. It is, therefore, intended that such changes and modifications be covered by the appended claims.

What is claimed is:

1. A volleyball training device adapted to securely rest on top of a basketball hoop, said training device comprising:

a backboard being shaped to cooperatively engage with said basketball hoop to prevent said backboard from horizontally sliding relative to said basketball hoop;

a tether secured to said backboard; and a pair of elastic bands for securing a volleyball to said tether.

2. A volleyball training device according to claim 1, wherein said backboard has a recess shaped to receive said basketball hoop.

3. A volleyball training devices according to claim 1, further comprising a handle in said backboard.

4. A volleyball training device according to claim 1, wherein said tether is made of elastic tubing.

5. A volleyball training device adapted to securely rest on top of a basketball hoop, said training device comprising:

a backboard being shaped to cooperatively engage with said basketball hoop to prevent said backboard from horizontally sliding relative to said basketball hoop;

a tether secured to said backboard; and at least one elastic strap secured adjacent opposite edges of said backboard for securing said backboard to said hoop.

6. A volleyball training device according to claim 5, wherein an end of said strap is secured through a hole adjacent one edge of said backboard and the opposite end of said strap is knotted and securable in a slot in an opposite side of said backboard.

7. A volleyball training device for suspending a volleyball, said volleyball training device being adapted to securely rest on a basketball hoop in a slip-resistant manner, said training device comprising:

a backboard having a recess shaped to receive said basketball hoop;

a tether having a first end secured to said backboard; and a means for securing a volleyball to a second end of said tether;

wherein said tether is adjustably secured to said board in a position within said hoop.

8. A volleyball training device according to claim 7, further comprising a means for securing said backboard to said hoop.

9. A volleyball training device according to claim 8, wherein said means for securing said backboard comprises at least one elastic strap which is securable across a bottom surface of said backboard under said hoop.

10. A volleyball training device according to claim 7, wherein said means for securing a volleyball comprises a plurality of bands secured to a second end of said tether.

11. A volleyball training device according to claim 7, wherein said recess is shaped to receive a bracket on which said hoop is mounted.

12. A volleyball training device according to claim 11, wherein said recess is stepped in shape to cooperatively receive one of multiple sizes for said bracket.

13. A volleyball training device for suspending a volleyball under a basketball hoop consisting essentially of:

a backboard configured to lie directly across the top of said hoop and engage said hoop to resist horizontal slipping thereon;

a tether having a first end secured to said backboard;

a plurality of bands secured to a second end of said tether for securing said volleyball; and at least one strap secured across a bottom surface of said backboard under said hoop for securing said backboard to said hoop.

14. A volleyball training device according to claim 13, wherein said tether is made tubular elastic material.

15. A volleyball training device according to claim 13, wherein said tether extends through a plurality of holes in said backboard.

16. A volleyball training device for suspending a volleyball, said volleyball training device being adapted to securely rest on a basketball hoop in a slip-resistant manner, said training device comprising:

a backboard having a recess shaped to receive said basketball hoop;

a tether having a first end secured to said backboard; and a plurality of bands secured to a second end of said tether for securing a volleyball to a second end of said tether.

17. A volleyball training device according to claim 16, further comprising a means for securing said backboard to said hoop.

18. A volleyball training device according to claim 17, wherein said means for securing said backboard comprises at least one elastic strap which is securable across a bottom surface of said backboard under said hoop.

19. A volleyball training device according to claim 17, wherein said tether is adjustably secured to said board in a position within said hoop.

20. A volleyball training device according to claim 16, wherein said recess is shaped to receive a bracket on which said hoop is mounted.

21. A volleyball training device according to claim 20, wherein said recess is stepped in shape to cooperatively receive one of multiple sizes for said bracket.

22. A volleyball training device for suspending a volleyball, said volleyball training device being adapted to securely rest on a basketball hoop in a slip-resistant manner, said training device comprising:

a backboard having a recess shaped to receive said basketball hoop, said recess being stepped in shape to cooperatively receive one of multiple sizes for a bracket on which said hoop is mounted;

a tether having a first end secured to said backboard; and a means for securing a volleyball to a second end of said tether.

23. A volleyball training device according to claim 22, further comprising a means for securing said backboard to said hoop.

* * * * *

UNITED STATES PATENT AND TRADEMARK OFFICE

CERTIFICATE OF CORRECTION

PATENT NO. : 5,575,481

DATED : November 19, 1996

INVENTOR(S) : John F. Lovetere and Lyne A. Lovetere

It is certified that error appears in the above-indentified patent and that said Letters Patent is hereby corrected as shown below:

Column 4, line 66 change "54" to --24--.

Signed and Sealed this

Twenty-second Day of April, 1997

Bruce Lehman

*Attest:*

BRUCE LEHMAN

*Attesting Officer*

*Commissioner of Patents and Trademarks*